US010236640B2

(12) United States Patent
Pamart et al.

(10) Patent No.: US 10,236,640 B2
(45) Date of Patent: Mar. 19, 2019

(54) ELECTRICAL CONNECTOR FOR A SAFETY RESTRAINT SYSTEM

(71) Applicant: Tyco Electronics France SAS, Pontoise (FR)

(72) Inventors: Olivier Pamart, Ecouen (FR); Nicolas Simon, La Garenne Colombes (FR); Xavier Rouillard, Franconville la Garenne (FR); Francois Jodon De Villeroche, La Celle St Cloud (FR)

(73) Assignee: Tyco Electronics France SAS, Pontoise (FR)

( * ) Notice: Subject to any disclaimer, the term of this patent is extended or adjusted under 35 U.S.C. 154(b) by 0 days.

(21) Appl. No.: 15/826,127

(22) Filed: Nov. 29, 2017

(65) Prior Publication Data

US 2018/0151989 A1 May 31, 2018

(30) Foreign Application Priority Data

Nov. 30, 2016 (FR) ..... 16 61765

(51) Int. Cl.
*H01R 29/00* (2006.01)
*H01R 13/71* (2006.01)
(Continued)

(52) U.S. Cl.
CPC ..... *H01R 13/71* (2013.01); *H01R 13/11* (2013.01); *H01R 13/6273* (2013.01);
(Continued)

(58) Field of Classification Search
CPC ..... H01R 13/71; H01R 13/11; H01R 13/6273
(Continued)

(56) References Cited

U.S. PATENT DOCUMENTS 3,869,191 A * 3/1975 Tolnar, Jr. ..... H01R 29/00 439/186
4,261,263 A * 4/1981 Coultas ..... F42B 3/18 102/202.7
(Continued)

FOREIGN PATENT DOCUMENTS

EP 0461307 A1 3/1991
EP 1054481 A1 11/2000
(Continued)

*Primary Examiner* — Abdullah A Riyami
*Assistant Examiner* — Vladimir Imas
(74) *Attorney, Agent, or Firm* — Barley Snyder

(57) ABSTRACT

An electrical connector for a safety restraint system comprises a connector housing, a plurality of contact elements disposed in the connector housing, an activation member movable relative to the connector housing in an activation direction between a deactivation position and an activation position, and a short-circuiting member disposed on the activation member. The connector housing is adapted to be plugged into a mating connector in a plug-in direction. The contact elements are adapted to be brought into electrical contact with a plurality of mating contact elements of the mating connector. The short-circuiting member is disposed on the activation member and electrically connects the contact elements only in the deactivation position. The contact elements are not electrically connected to one another in the activation position.

12 Claims, 8 Drawing Sheets

(51) Int. Cl.
*H01R 13/11* (2006.01)
*H01R 13/627* (2006.01)
*H01R 13/641* (2006.01)
*H01R 13/703* (2006.01)

(52) U.S. Cl.
CPC ..... *H01R 13/641* (2013.01); *H01R 13/7032* (2013.01); *H01R 2201/26* (2013.01)

(58) Field of Classification Search
USPC ..... 439/188
See application file for complete search history.

(56) References Cited

U.S. PATENT DOCUMENTS 4,306,499 A * 12/1981 Holmes ..... F42B 3/18 102/202.4
4,433,888 A * 2/1984 Winger ..... H01R 13/4367 439/328
4,894,019 A * 1/1990 Howard ..... H01H 13/12 200/51.09
5,174,786 A * 12/1992 Kato ..... H01R 13/641 439/352
5,275,575 A * 1/1994 Cahaly ..... H01R 13/7032 200/51.1
5,334,025 A * 8/1994 Fohl ..... B60R 21/017 200/51.1
5,401,180 A * 3/1995 Muzslay ..... H01R 13/7032 102/202.2
5,516,300 A * 5/1996 Tsuji ..... H01R 13/701 200/51 R
5,538,434 A * 7/1996 DelGuidice ..... H01R 4/2433 439/188
5,562,486 A * 10/1996 Saijo ..... H01R 13/4362 439/188
5,672,073 A * 9/1997 Matsumura ..... H01R 13/641 439/188
5,720,206 A * 2/1998 Watanabe ..... F16H 57/027 74/421 A
6,203,342 B1 * 3/2001 Gauker ..... H01R 13/7032 439/188
6,217,388 B1 * 4/2001 Francis ..... H01R 13/7197 439/352
6,419,510 B2 * 7/2002 Shiraki ..... H01R 13/7032 439/188
6,422,897 B1 * 7/2002 Odorfer ..... H01R 13/7032 439/188
6,435,894 B2 * 8/2002 Little ..... H01R 13/639 439/188
6,544,060 B2 * 4/2003 Wakui ..... B60R 21/017 439/188
6,893,277 B2 * 5/2005 Parrish ..... H01R 13/506 439/188
6,910,902 B2 * 6/2005 Osada ..... B60R 21/26 439/188
7,121,867 B2 * 10/2006 Annecke ..... H01R 13/6273 439/352
7,833,044 B2 * 11/2010 Bouchan ..... H01R 13/6273 439/352
8,968,021 B1 * 3/2015 Kennedy ..... H01R 13/6273 439/352
9,130,306 B2 * 9/2015 Hotea ..... H01R 13/506
9,147,971 B2 * 9/2015 Osada ..... H01R 13/639
9,172,183 B2 * 10/2015 Siwek ..... H01R 13/6273
9,356,394 B2 * 5/2016 Kennedy ..... H01R 13/6273
9,409,536 B2 * 8/2016 Gunreben ..... B60R 21/16
9,614,323 B2 * 4/2017 Chen ..... H01R 13/6273
9,614,327 B2 * 4/2017 Marsh ..... H01R 13/639
9,780,502 B2 * 10/2017 Nuetzel ..... H01R 13/642
9,893,455 B1 * 2/2018 Brodsky ..... H01R 13/44
2002/0160645 A1 * 10/2002 Nagamine ..... H01R 13/6273 439/352
2004/0248475 A1 * 12/2004 Seminara ..... F42B 3/26 439/680
2005/0009390 A1 * 1/2005 Barker ..... H01R 13/627 439/188

FOREIGN PATENT DOCUMENTS

WO 2010143078 A2 6/2010
WO 2011058189 A1 5/2011

* cited by examiner

ELECTRICAL CONNECTOR FOR A SAFETY RESTRAINT SYSTEM

CROSS-REFERENCE TO RELATED APPLICATION

This application claims the benefit of the filing date under 35 U.S.C. § 119(a)-(d) of French Patent Application No. 1661765, filed on Nov. 30, 2016.

FIELD OF THE INVENTION

The present invention relates to an electrical connector and, more particularly, to an electrical connector having contact elements that are short-circuited when the connector is separated from a mating connector.

BACKGROUND

Safety restraint systems in motor vehicles, such as safety belts and airbags, conventionally have pyrotechnic devices or charges that are able to trigger the tightening of a belt and/or the inflation of an airbag. The pyrotechnic device is triggered depending on shock and/or vibration data received by the vehicle's sensors. The control unit of such a sensor is generally linked to a corresponding pyrotechnic device by an electrical connector, also referred to as a pyrotechnic connector, which must be plugged and locked into a socket forming the mating connector. The mating connector is also referred to as an igniter support.

The electrical circuit of the safety restraint system should be deactivated when the pyrotechnic connector is separated from the mating connector to avoid unintentional activation of the system and the pyrotechnic discharge. Disconnecting the pyrotechnic connector from the mating connector could produce an electrostatic discharge, unintentionally activating the pyrotechnic device. Conventionally, the pyrotechnic connector and/or the mating connector are electrically or electronically monitored in order to verify both that the electrical circuit is effectively deactivated when the electrical connector is separated from the socket and that the electrical circuit is only activated when the electrical connector is correctly plugged into the socket.

Patent applications WO 2010/143078 A2 and WO 2011/058189 A1 disclose examples of electrical connectors for safety restraint systems such as an airbag in which, when a plug-in connector is separated from the mating connector, the electrically conductive contact elements of the electrical connector directly contact one another, producing a short-circuiting line. It is possible to ensure that the electrical circuit is deactivated as long as this short-circuiting line is not interrupted. The short-circuiting line is produced by an electrically conductive, resiliently deformable short-circuiting leg or tab provided on each of the contact pins of the connector. The tab of a contact pin is in physical contact, and therefore electrical contact, with the tab of the other contact pin, producing the short-circuit.

Once the electrical connector is correctly plugged into the mating connector, WO 2010/143078 A2 and WO 2011/058189 A1 further disclose the use of a connector position assurance ("CPA") device. The CPA device not only locks the system but also activates the electrical circuit by interrupting the short-circuiting line. When the CPA device locks the system, a part of the CPA device is inserted between the short-circuiting tabs, separating the short-circuiting tabs and permitting activation of the electrical circuit of the safety restraint system. Upon a disconnection and once the CPA device has returned to its delivery position, the elastic return of the short-circuiting tabs to their initial position restores the short-circuit of the contact pins, thus deactivating the electrical circuit.

In these known systems, however, the metal tabs used for the short-circuit connection are thin and flat; the elasticity of tabs can be compromised after a certain number of system connections/disconnections. Failure of the elasticity of the tabs has a direct impact on the reliability of the electrical tests concerning the activated or deactivated state of the system.

SUMMARY

An electrical connector for a safety restraint system according to the invention comprises a connector housing, a plurality of contact elements disposed in the connector housing, an activation member movable relative to the connector housing in an activation direction between a deactivation position and an activation position, and a short-circuiting member disposed on the activation member. The connector housing is adapted to be plugged into a mating connector in a plug-in direction. The contact elements are adapted to be brought into electrical contact with a plurality of mating contact elements of the mating connector. The short-circuiting member is disposed on the activation member and electrically connects the contact elements only in the deactivation position. The contact elements are not electrically connected to one another in the activation position.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
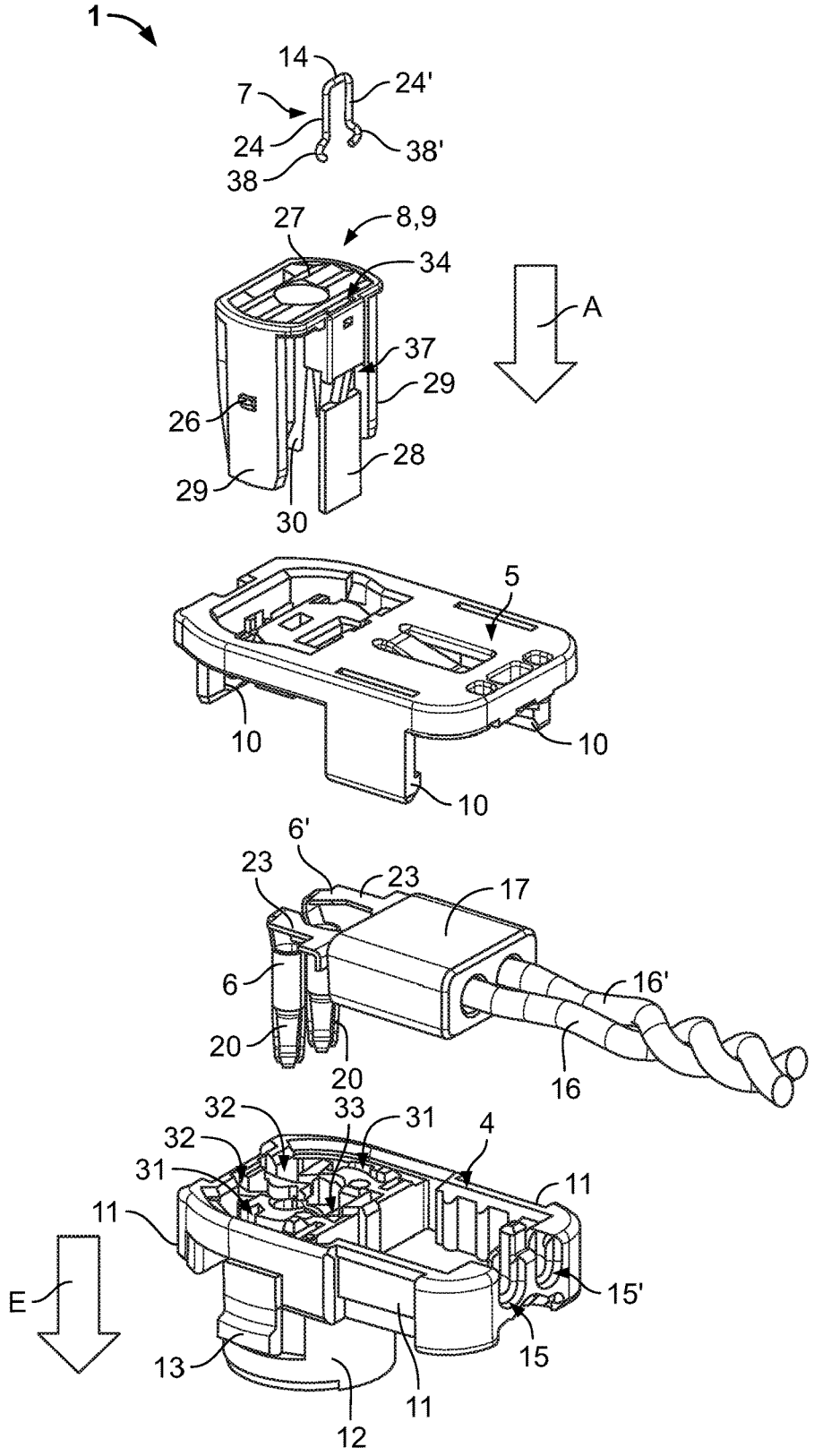
FIG. 1 is an exploded perspective view of an electrical connector according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 3:
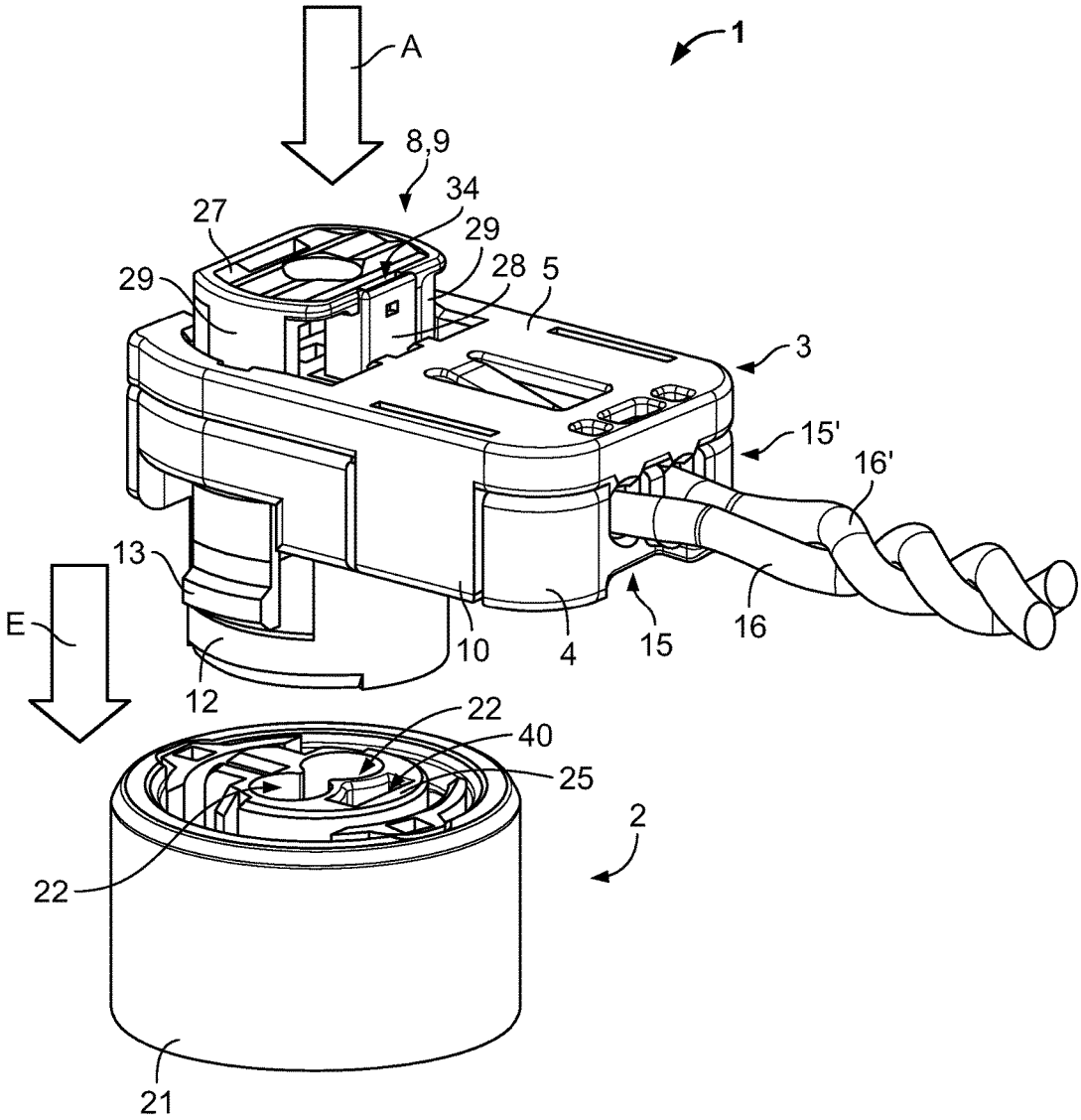
FIG. 3 is a perspective view of the electrical connector of FIG. 1 and a mating connector separated from one another.
Figure 4:
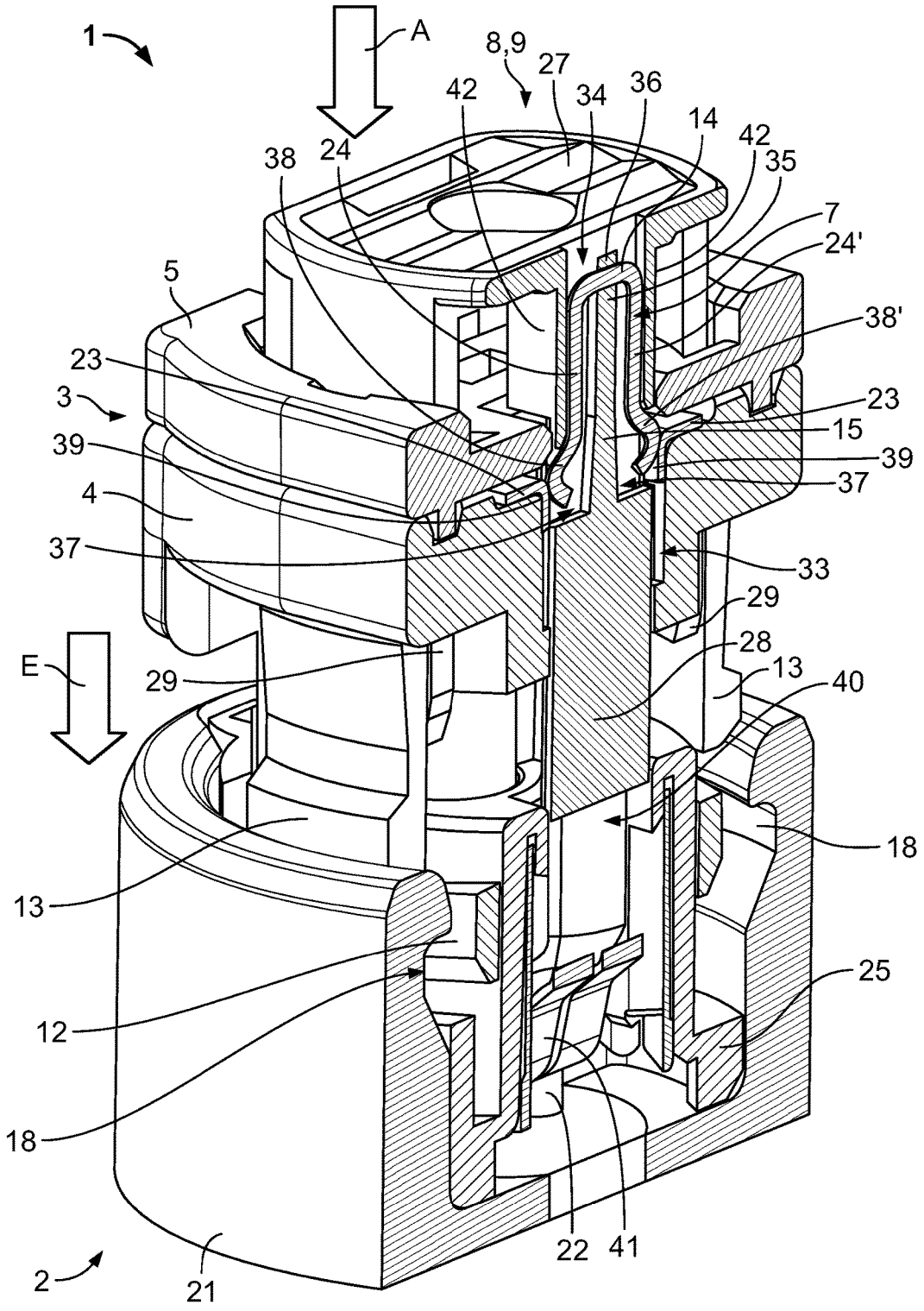
FIG. 4 is a sectional perspective view of the electrical connector and the mating connector of FIG. 3 in an intermediate position.

An electrical connector 1 according to an embodiment of the present invention is shown in FIGS. 1, 3, and 4. The electrical connector 1, as shown in FIGS. 1 and 3, comprises a connector housing 3, including a connector body 4 and a cover 5, at least two electrically conductive contact elements 6, 6', a short-circuiting member 7, and an activation member 8.

The cover 5 and the connector body 4, as shown in FIGS. 1 and 3, are capable of being detachably assembled and locked together by corresponding locking members 10 and mating locking members 11. The cover 5 can be removed from the connector body 4 if needed, for example, during assembly, maintenance, or repair operations of the electrical connector 1.

The connector body 4 has a plug-in area 12 configured to be inserted or plugged into a mating connector 2 in a plug-in direction E, as shown in FIGS. 1 and 3. Locking shoulders 13 are disposed on the plug-in area 12 in order to lock the electrical connector 1 in the mating connector 2. The locking between the electrical connector 1 and the mating connector 2 is referred to as the main locking or primary locking. The mating connector 2, as shown in FIGS. 3, 4, 6, 7A, and 7B, comprises a base 21 in which a retaining part 25 and a grounding element 41 are fitted.

The connector body 4 has apertures 15, 15' for electric cables 16, 16' at an end of the connector body 4 opposite the plug-in area 12 as shown in FIG. 1. In an embodiment, the electric cables 16, 16' are covered with an insulating sheath, and an uninsulated end of each electric cable 16, 16' is disposed inside the connector housing 3 and connected to a respective contact element 6, 6'. This connection may be made by crimping the uninsulated end of the electric cable 16, 16' in a respective connection terminal 19 of the contact element 6, 6', shown in FIG. 5, and is protected by a ferrite filter 17.

Figure 5:
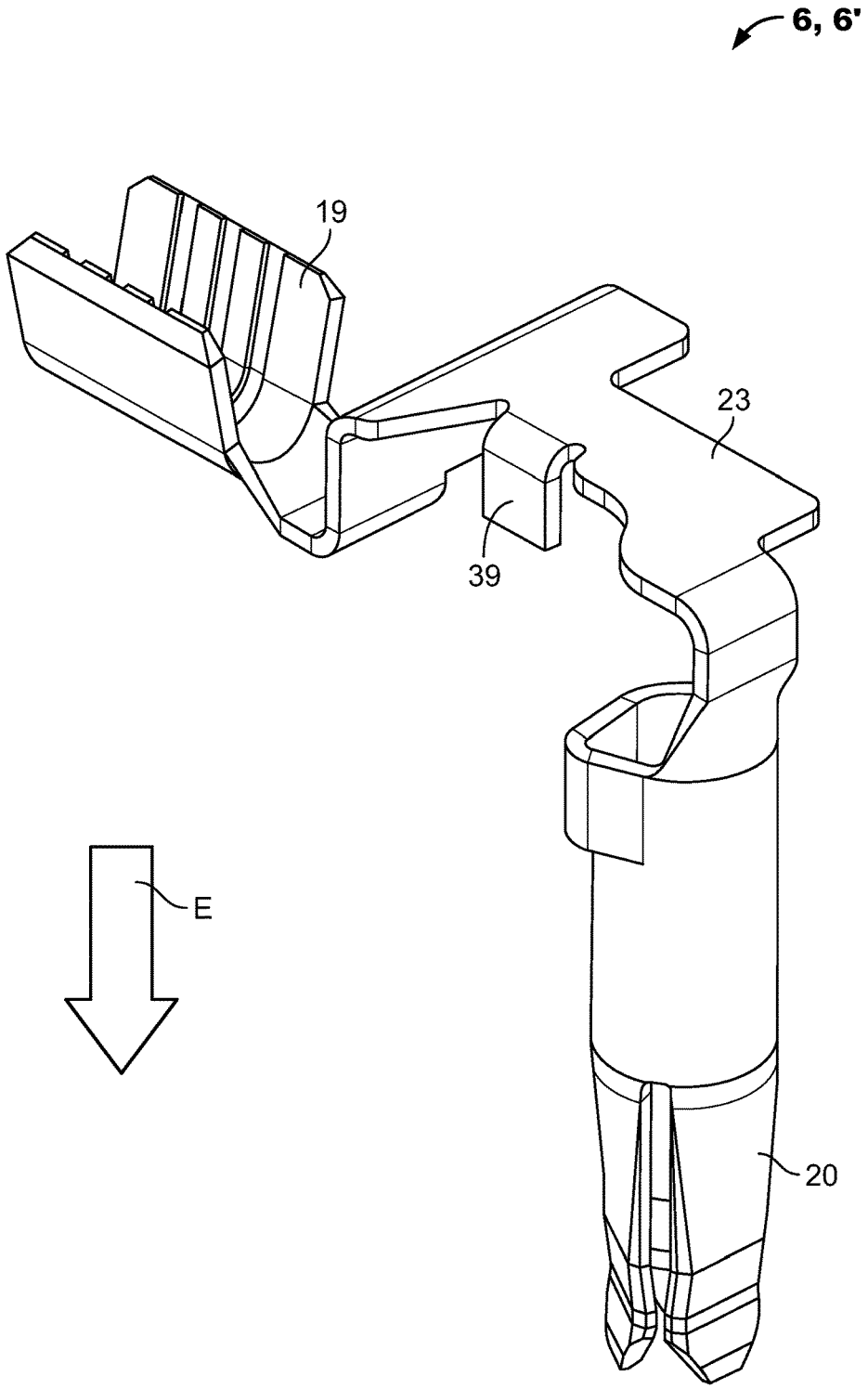
FIG. 5 is a perspective view of a contact element of the electrical connector of FIG. 1.

The contact element 6, 6' is shown in FIG. 5. The contact element 6, 6' has the connection terminal 19 at a first end and a contact area 20 at an opposite second end. The first end of the contact element 6, 6' extends parallel to a longitudinal direction of the connector housing 3 and corresponds to a mounting direction of the electric cable 16, 16' in the connection terminal 19. The connection terminal 19 and the contact area 20 are connected by an intermediate part 23 which has a shape complementary to the connector housing 3 and which forms a bend so that the connection terminal 19 is substantially perpendicular to the contact area 20. The contact area 20 extends in the plug-in direction E. The contact area 20 electrically contacts a respective mating contact element 22, for example a contact pin, of the mating connector 2 when the electrical connector 1 and the mating connector 2 are connected in the plug-in direction E.

The short-circuiting member 7, as shown in FIG. 1, is an electrically conductive element which is distinct from the contact elements 6, 6'. The short-circuiting member 7 is disposed on the activation member 8 as shown in FIGS. 2A-2C, 4, 6 and 7B. The short-circuiting member 7 is an electrically conductive linking piece and has as many arms or branches as there are contact elements 6, 6' to be short-circuited in a deactivation position. In the shown embodiment, the short-circuiting member 7 has two short-circuiting arms 24, 24' which form a substantially U-shaped geometry starting from their common end 14.

The activation member 8, which is in a deactivation position in FIG. 3, is preassembled on the connector housing 3 in the deactivation position. The activation member 8 has locking lugs 26, shown in FIG. 1, preventing the activation member 8 from being unintentionally removed from the connector housing 3 by engaging with mating locking members (not shown) of the connector housing 3. The activation member 8 has an actuation surface 27 substantially perpendicular to the plug-in direction E when the activation member 8 is preassembled on the connector housing 3.

The activation member 8 has an activation part 28, in the form of a leg in the embodiment shown in FIG. 1, which is the part of the activation member 8 on which the short-circuiting member 7 is disposed, as well as guiding parts 29 and locking members 30 which all extend from the actuation surface 27 substantially in the plug-in direction E. The activation part 28, as shown in FIGS. 1 and 3, extends from the edge of the side of the actuation surface 27 oriented towards the part of the connector housing 3 which receives the electric cables 16, 16'. The locking members 30 extend from the edge of the opposite side of the actuation surface 27. The guiding parts 29 extend from each of the intermediate sides of the actuation surface 27, which are each substantially rectangular in the shown embodiment.

Figure 2C:
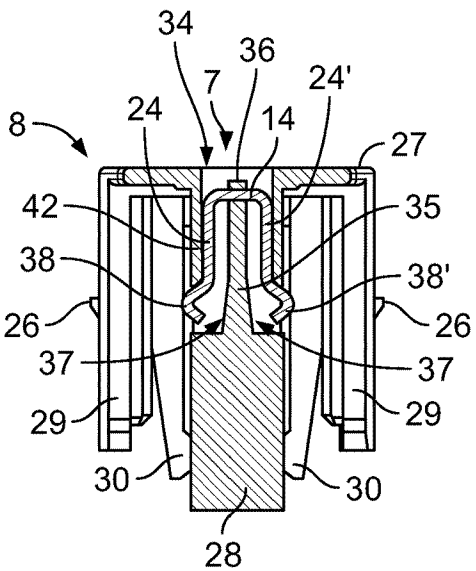
FIG. 2C is a sectional view of the short-circuiting member and the activation member in a third position.
Figure 2B:
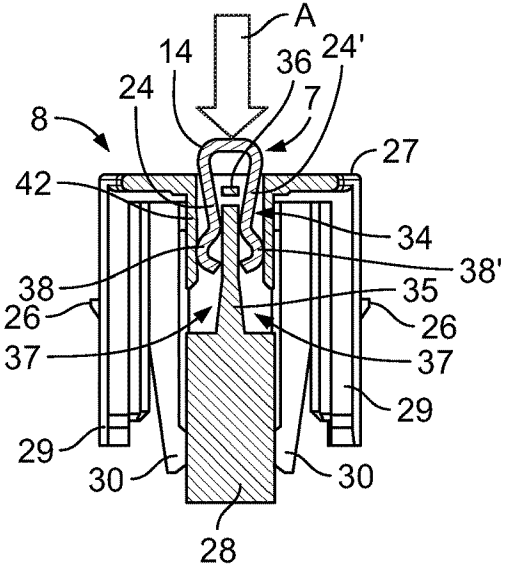
FIG. 2B is a sectional view of the short-circuiting member and the activation member in a second position.
Figure 2A:
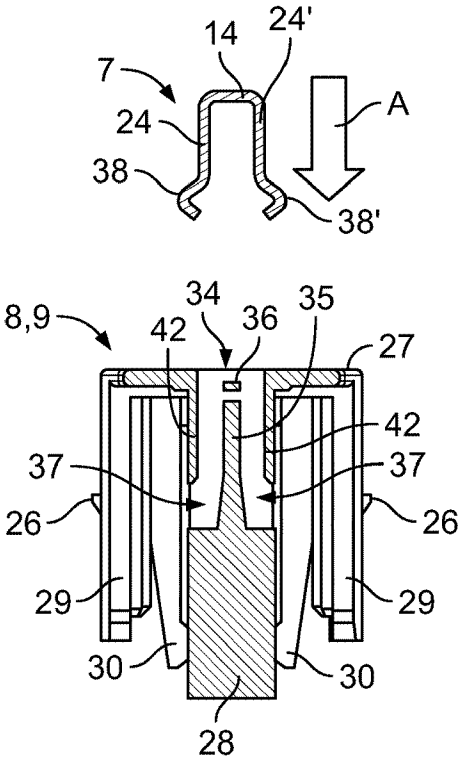
FIG. 2A is a sectional view of a short-circuiting member and an activation member of the connector of FIG. 1 in a first position.

As shown in FIGS. 2A-2C, the short-circuiting member 7 is fitted in a fitting area 34 of the activation member 8. In an embodiment, the short-circuiting member 7 is removably fitted in the fitting area 34 in order to facilitate its replacement or checking during a maintenance operation. In an alternative embodiment, the activation member 8 is molded around the short-circuiting member 7 and the short-circuiting member 7 is not removable. The fitting area 34 is one or more recesses disposed in the activation part 28 of the activation member 8; in the shown embodiment, the fitting area 34 is a recess between external walls 42 of the activation part 28. The short-circuiting member 7 is inserted into the fitting area 34 through an aperture on the actuation surface 27 in a direction corresponding substantially to the activation direction A or to the plug-in direction E.

The fitting area 34, as shown in FIG. 2A, forms an intermediate wall 35 in the activation part 28. The short-circuiting arms 24, 24' of the short-circuiting member 7 are received on either side of the intermediate wall and the common end 14 of the short-circuiting member 7 abuts a peak of the intermediate wall 35 when the short-circuiting member 7 is fully inserted into the fitting area 34, as shown in FIGS. 2B and 2C. The fitting area 34 has a retaining lug 36 oriented so as to be surmounted by the common end 14 upon insertion of the short-circuiting member 7 in the fitting area 34 and to then prevent an unintentional release of the short-circuiting member 7 when it is fully inserted into the fitting area 34, as shown in FIG. 2C.

In an embodiment, the short-circuiting member 7 has a certain elasticity in order to facilitate its insertion into the fitting area 34. FIG. 2B shows the short-circuiting member 7 with its short-circuiting arms 24, 24' deflected elastically inwards while passing into the fitting area 34, and FIG. 2C shows the short-circuiting arms 24, 24' returned elastically to their initial position when the short-circuiting member 7 is correctly accommodated in the fitting area 34.

The fitting area 34 has, at its end opposite the actuation surface 27, suitable apertures 37 on either side of the external walls 42 of the activation part 28 permitting connection ends 38, 38' of the short-circuiting arms 24, 24' to project outside of the activation part 28 as shown in FIG. 2C. In the shown embodiment, the connection ends 38, 38' are bosses projecting toward the exterior of the short-circuiting member 7. The connection ends 38, 38' project further outwards than the activation part 28 in a direction substantially perpendicular to the activation direction A. In other embodiments, the short-circuiting member 7 has different shapes, for example a metal segment or other geometries, provided that the short-circuiting member 7 projects sufficiently towards the exterior of the activation part 28 to electrically connect the contact elements 6, 6' in the deactivation position without interfering with a displacement of the activation member 8 relative to the connector housing 3.

The activation member 8, with the short-circuiting member 7 received, is assembled on the connector housing 3. As shown in FIG. 1, the cover 5 of the connector housing 3 has respective apertures through which the activation part 28, the guiding parts 29 and the locking members 30 extend. The connector housing 3, in particular the plug-in area 12 of the connector body 4, receives the activation part 28, the guiding parts 29, and the locking members 30. The plug-in area 12 has guiding flanges 31 in which the guiding parts 29 are received so that the activation member 8 is only displaceable in the plug-in direction E. The plug-in area 12 has locking flanges 32 receiving the locking members 30 and a connection area 33 receiving the activation part 28.

Figure 7A:
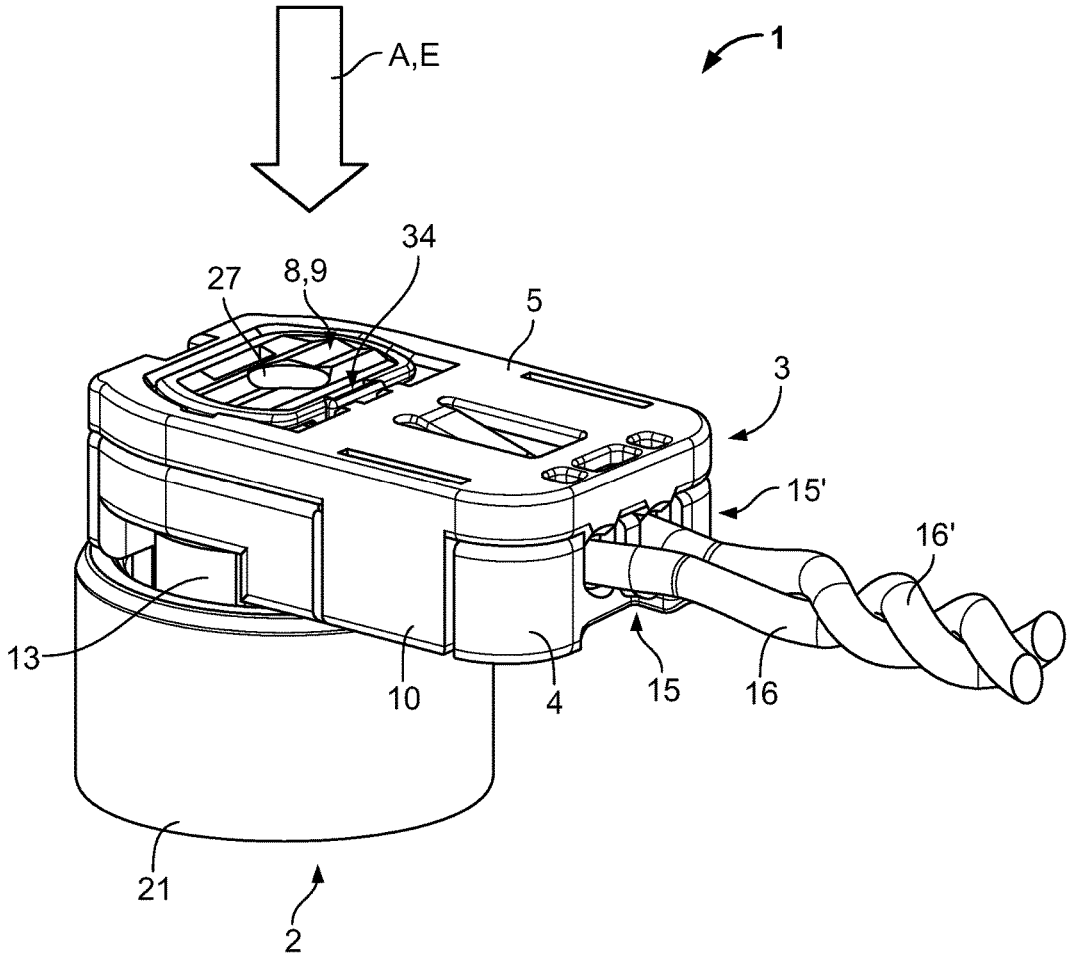
FIG. 7A is perspective view of the electrical connector plugged and locked into the mating connector of FIG. 3 with the activation member in an activation position.
Figure 7B:
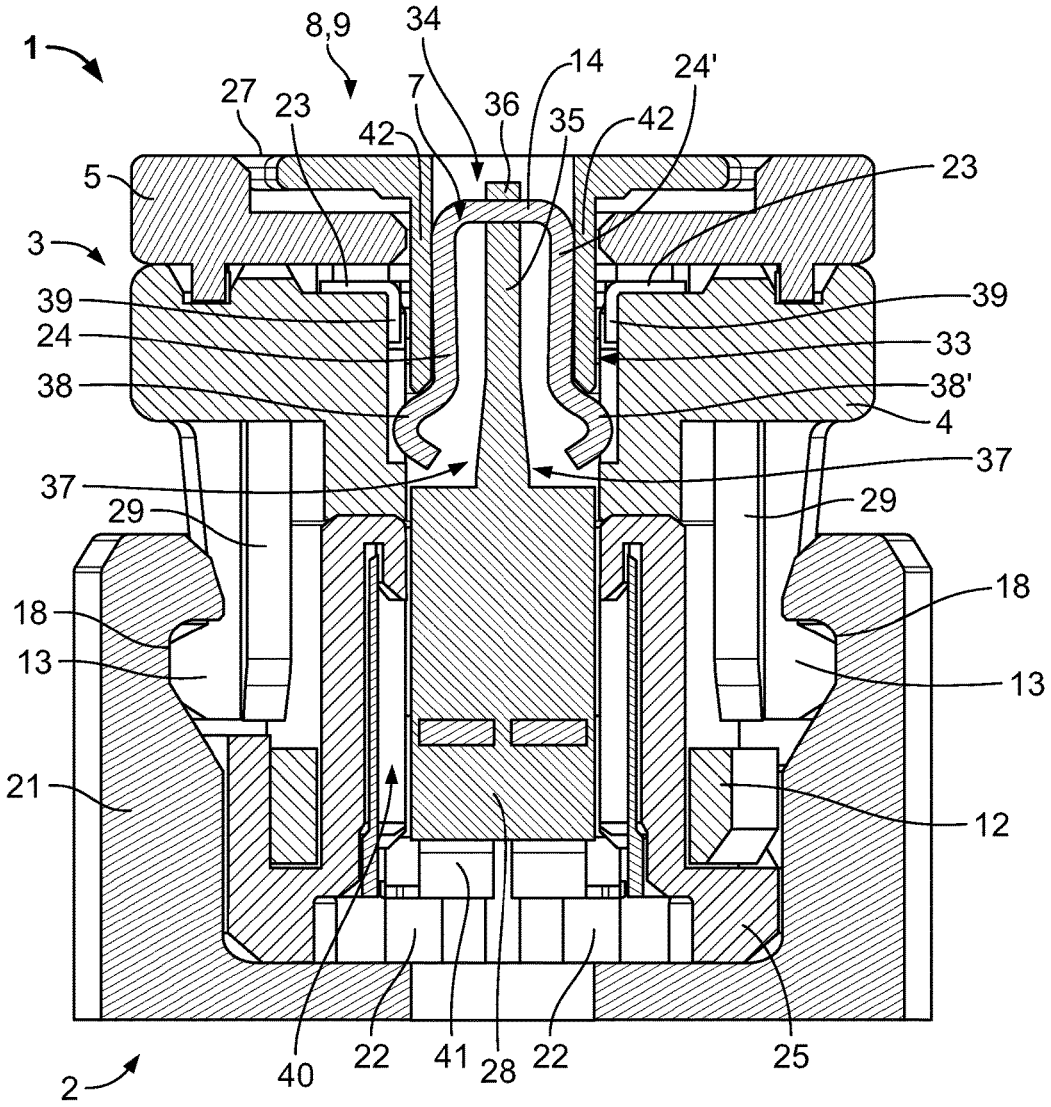
FIG. 7B is a sectional view of the electrical connector plugged and locked into the mating connector of FIG. 3 with the activation member in the activation position.

The electrical connector 1 and the mating connector 2 are shown separated in FIG. 3 and fully mated in FIGS. 7A and 7B. The activation member 8 has one or more projections at the walls of the locking members 30 which abut against one or more corresponding projections in the connector housing 3. The projections prevent the activation member 8 from being switched from the deactivation position, shown in FIG. 3, to the activation position, shown in FIGS. 7A and 7B, as long as the electrical connector 1 and the mating connector 2 are not fully mated. When the electrical connector 1 is correctly plugged into the mating connector 2, the locking members 30 are deflected laterally and the activation member 8 is freed to be displaced further into the housing connector 3 in the activation direction A.

In the deactivation position shown in FIGS. 3 and 4, the activation member 8 is blocked from moving in the activation direction A; the activation member 8 may not advance further into the connector housing 3 or be withdrawn therefrom. In this position, the short-circuiting member 7 establishes a physical and electrical contact between the contact elements 6, 6'. The short-circuiting member 7 short-circuits the contact elements 6, 6' in the deactivation position and makes it possible to report on the disconnection of the electrical circuit of the safety restraint system during an electrical or electronic test.

The electrical connector 1 is plugged into the mating connector 2 in the plug-in direction E. FIG. 4 shows a state wherein the electrical connector 1 has been displaced in the plug-in direction E so as to establish a first physical contact between the electrical connector 1 and the mating connector 2. The plug-in area 12 of the electrical connector 1 contacts the base 21 and the retaining part 25 of the mating connector 2. The electrical connector 1 is however not yet plugged into the mating connector 2; the locking shoulders 13 of the electrical connector 1 are not yet locked onto the locking area 18 of the mating connector 2 and, consequently, the activation member 8 is still blocked in its deactivation position. An electrical test would determine that the electrical circuit is still deactivated. The same electrical test would also reveal that the electrical connector 1 is not correctly plugged into the mating connector 2.

In the deactivation position, as shown in FIG. 4, the short-circuiting member 7 forms an electrical connection between the contact elements 6, 6'. The short-circuiting arms 24, 24' project towards the exterior relative to the activation part 28 which extends in the connection area 33 so as to pass between the contact elements 6, 6'. Each of the short-circuiting arms 24, 24' of the short-circuiting member 7 is in contact at its connection end 38, 38' with the intermediate part 23 of a respective contact element 6, 6'.

In an embodiment, each contact element 6, 6' has a short-circuiting part 39 at its intermediate part 23. The short-circuiting part 39 forms a bend with the intermediate part 23 and projects perpendicular to the intermediate part 23 in the plug-in direction E. The connection ends 38, 38' of the short-circuiting member 7 come into contact with the contact elements 6, 6' either at the bend between the intermediate part 23 and the short-circuiting part 39 or directly on the short-circuiting part 39. In an alternative embodiment in which a short-circuiting part 39 is not provided on the contact elements 6, 6', the connection ends 38, 38' of the short-circuiting member 7 come in contact with the edge of the intermediate part 23 in the deactivation position.

Figure 6:
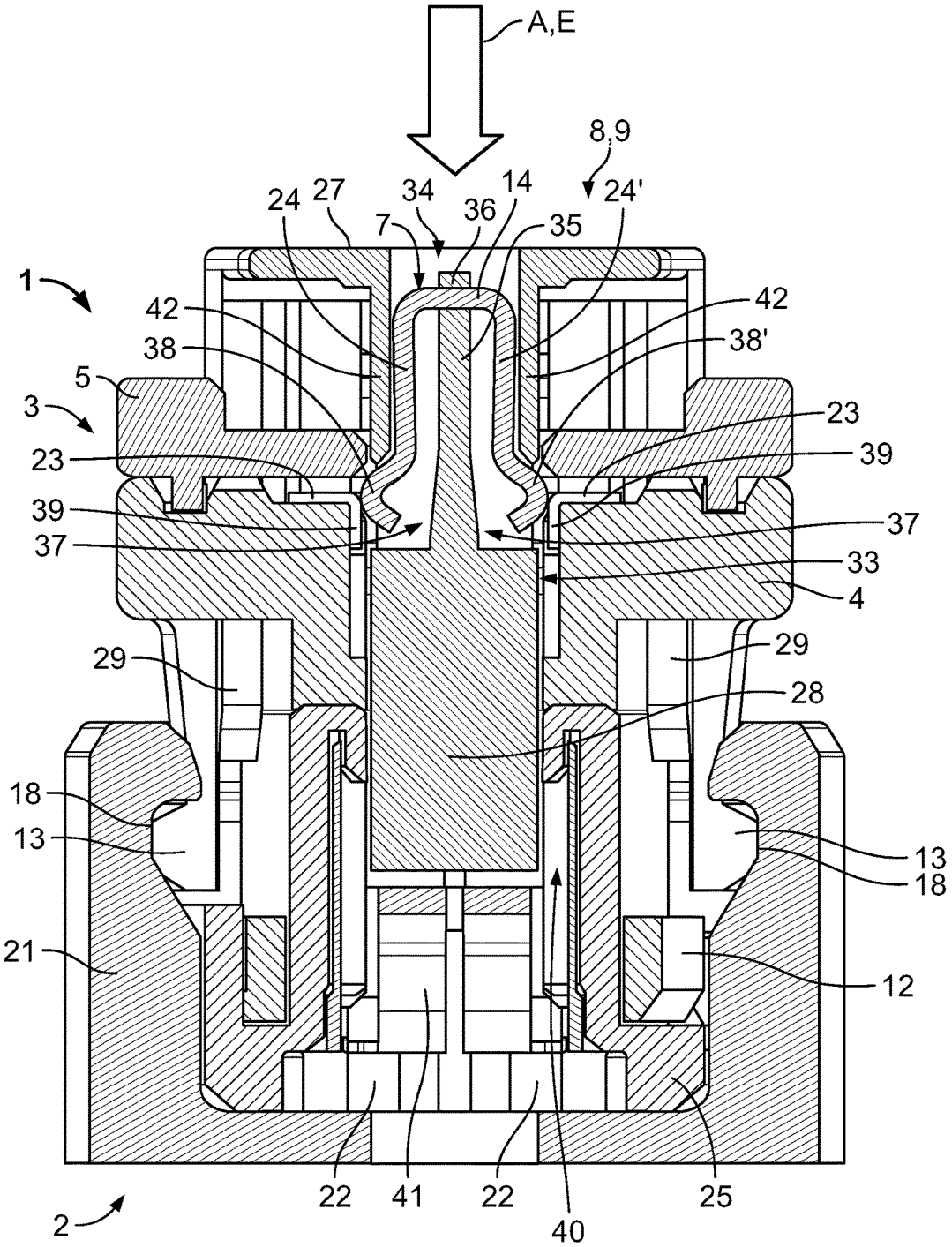
FIG. 6 is a sectional view of the electrical connector plugged into the mating connector of FIG. 3 with the activation member in a deactivation position.

The electrical connector 1, in particular its plug-in area 12, is inserted further into the mating connector 2 from the position shown in FIG. 4 by a force on the actuation surface 27 in the plug-in direction E to the position shown in FIG. 6. Until the electrical connector 1 is correctly inserted into the mating connector 2, the activation member 8 is blocked in the deactivation position.

FIG. 6 shows a state in which the electrical connector 1 has been displaced further into the mating connector 2 in the plug-in direction E to the activation of the main or primary locking. The electrical connector 1 is correctly fitted or plugged into the mating connector 2 in FIG. 6. In the shown embodiment, the activation member 8 is a connector position assurance ("CPA") device 9. After the electrical connector 1 is correctly plugged into the mating connector 2, primary locking shown in FIG. 6 is carried out by engagement of the locking shoulders 13 on the plug-in area 12 with a mating locking area 18 of the base 21 of the mating connector 2. The mating contact elements 22 of the mating connector 2 are engaged in the contact areas 20 of the contact elements 6, 6' of the electrical connector 1, which are still short-circuited by the short-circuiting member 7 of the activation member 8 which is still in its deactivation position. An electrical test would still determine that the electrical circuit is deactivated and would also reveal the absence of secondary locking.

The advance of the plug-in area 12 into the mating connector 2 causes the advance of the activation member 8 into the mating connector 2. The activation part 28 has advanced into a receiving area 40 of the retaining part 25 of the mating connector 2 in FIG. 6 as compared to the state depicted in FIG. 4. Now that the electrical connector 1 is correctly plugged into the mating connector 2, the locking members 30 of the activation member 8 are in a laterally deflected position such that the previously described abutment preventing the displacement of the activation member 8 to the activation position is released and the activation member 8 is freed. A force exerted onto the actuation surface 27 in the activation direction A in would switch the activation member 8 into its activation position.

The activation member 8 switches to the activation position by pressure on the actuation surface 27 in the activation direction A, which is substantially the same as the plug-in direction E of the electrical connector 1 as shown in FIGS. 7A and 7B. The elastic return of the locking members 30 to their initial position therefore makes it possible to lock them with the locking flanges 32, preventing an unintentional withdrawal of the activation member 8. The guiding parts 29 are wedged behind the locking shoulders 13 of the plug-in area 12, thus preventing an unintentional disconnection of the primary locking and an unintentional disconnection of the electrical connector 1 and the mating connector 2. This supplementary locking may be referred to as secondary locking.

The actuation surface 27, as shown in FIG. 7A, is flush with the cover in the fully mated position. In other embodiments, the actuation surface 27 could have a different geometry and is not necessarily aligned with the surface of the cover 5 in the activation position.

As shown in FIG. 7B, the activation part 28 has penetrated further into the receiving area 40 of the retaining part 25. The displacement of the activation part 28 causes the displacement of the short-circuiting member 7, which no longer contacts the contact elements 6, 6' of the electrical connector 1 in the activation position. The ends 38, 38' of the short-circuiting arms 24, 24' are sufficiently distant from the respective exposed parts of the contact elements 6, 6', that these are no longer short-circuited. The external walls 42 of the activation part 28 ensure the necessary electrical insulation between any part of the short-circuiting member 7 and exposed parts of the contact elements 6, 6', such as the intermediate part 23 and/or the short-circuiting part 39. An electrical test would determine that the electrical circuit is active and that the primary locking is effectively retained by the secondary locking. In other words, the electrical connector 1 is correctly plugged in and locked with the mating connector 2, and the system is ready to be used. In one single movement by pressure on the actuation surface 27, the electrical connector 1 is plugged into the mating connector 2 until the primary locking is activated, and the electrical circuit of the safety restraint system and the secondary locking are then simultaneously activated by moving the activation member 8 into the activation position.

What is claimed is:

1. An electrical connector for a safety restraint system, comprising:

a connector housing adapted to be plugged into a mating connector in a plug-in direction;

a plurality of contact elements disposed in the connector housing and adapted to be brought into electrical contact with a plurality of mating contact elements of the mating connector;

an activation member movable relative to the connector housing in an activation direction between a deactivation position and an activation position, the activation member movable into the activation position when the connector housing is fully mated with the mating connector; and a short-circuiting member disposed on the activation member and electrically connecting the plurality of contact elements only in the deactivation position, the plurality of contact elements not electrically connected to one another in the activation position.

2. The electrical connector of claim 1, wherein the short-circuiting member is displaced integrally with movement of the activation member between the deactivation position and the activation position.

3. The electrical connector of claim 1, wherein the activation member is adapted to lock the connector housing to the mating connector in the activation position.

4. The electrical connector of claim 1, wherein the activation direction is parallel to the plug-in direction.

5. The electrical connector of claim 1, wherein the short-circuiting member is removably disposed on the activation member.

6. The electrical connector of claim 1, wherein the activation member has a housing receiving the short-circuiting member in the activation direction.

7. The electrical connector of claim 1, wherein the short-circuiting member is resiliently deformable.

8. The electrical connector of claim 1, wherein the short-circuiting member has a plurality of short-circuit arms extending from a common end.

9. The electrical connector of claim 8, wherein each short-circuit arm has a connection end at an end opposite the common end, the connection end projecting in a direction perpendicular to the activation direction.

10. The electrical connector of claim 9, wherein each contact element has a short-circuiting part projecting in the activation direction.

11. The electrical connector of claim 10, wherein the connecting end of each short-circuit arm contacts one short-circuiting part in the deactivation position.

12. The electrical connector of claim 10, wherein a contact surface defined by each short-circuiting part extends in the activation direction.

* * * * *